US005449162A

United States Patent [19]

Saito et al.

[11] Patent Number: 5,449,162

[45] Date of Patent: Sep. 12, 1995

[54] SHEET FEEDING DEVICE WITH ADJUSTABLE FEEDING AND INVERSELY-ROTATING ROLLERS

[75] Inventors: Yoshihiro Saito, Hachiouji; Masahiko Ito; Satoru Fukasawa, both of Yokohama, all of Japan

[73] Assignee: Canon Kabushiki Kaisha, Tokyo, Japan

[21] Appl. No.: 165,800

[22] Filed: Dec. 13, 1993

[30] Foreign Application Priority Data

Dec. 28, 1992 [JP] Japan ..... 4-361207

[51] Int. Cl.[6] ..... B65H 3/52

[52] U.S. Cl. ..... 271/122; 271/125

[58] Field of Search ..... 271/10, 117, 125, 124, 271/122

[56] References Cited

U.S. PATENT DOCUMENTS 4,858,905 8/1989 Weigel ..... 271/125 X 5,172,900 12/1992 Uno et al. ..... 271/125

FOREIGN PATENT DOCUMENTS 55-111337 8/1980 Japan ..... 271/125

*Primary Examiner*—David H. Bollinger

*Attorney, Agent, or Firm*—Fitzpatrick, Cella, Harper & Scinto

[57] ABSTRACT

A sheet feeding device includes a feeding roller, which has a plurality of large-diameter portions and which rotates in a sheet-feeding direction, an inversely-rotating roller, which has a plurality of large-diameter portions alternately disposed with respect to the large-diameter portions of the feeding roller and which rotates in a direction reverse to the sheet-feeding direction, and an automatic adjustment unit for automatically adjusting the amount of overlap between the large-diameter portions of the feeding roller and the large-diameter portions of the inveresely-rotating roller in accordance with a sheet-feeding state.

35 Claims, 10 Drawing Sheets

SHEET FEEDING DEVICE WITH ADJUSTABLE FEEDING AND INVERSELY-ROTATING ROLLERS

BACKGROUND OF THE INVENTION

FIELD OF THE INVENTION

This invention relates to a sheet feeding device for supplying sheets of originals, transfer paper or the like to an electronic filing apparatus, a copier, a printer, a facsimile apparatus or the like.

DESCRIPTION OF THE RELATED ART

As shown in FIG. 9, in some sheet feeding devices for supplying sheets of mounted originals, transfer paper or the like to various kinds of apparatuses, there is a separation mechanism, which includes a feeding roller 101 comprising large-diameter portions 101*a* and a small-diameter portion 101*b*, and an inversely-rotating roller 102 comprising large-diameter portions 102*a* and a small-diameter portion 102*b*. The large-diameter portions of the feeding roller 101 and the large-diameter portions of the inversely-rotating roller 102 are alternately disposed, so that these portions of the respective rollers can overlap in the direction of their diameters.

A driving system (not shown) for transmitting its driving force to inversely-rotating roller 102 includes a torque limiter for disconnecting the transmission of the driving force when a load having at least a predetermined value is applied to inversely-rotating member 102, and a one-way clutch for regulating the rotation of inversely-rotating roller 102 in the forward direction.

If multiple sheets are fed from among mounted sheets, sheets present at the side of inversely-rotating roller 102 are sequentially returned by inversely-rotating roller 102, and only one sheet present at the side of feeding roller 101 is separated and fed. While the one sheet is fed, inversely-rotating roller 102 is stopped by the one-way clutch to regulate the movement of sheets other than the fed sheet in the feeding direction.

In the above-described separation mechanism in which the large-diameter portions of feeding roller 101 and the large-diameter portions of inversely-rotating roller 102 are alternately disposed, since respective adjacent large-diameter portions do not contact each other, and the amount of overlap in the direction of their diameter can be changed, the separation force of inversely-rotating roller 102 can be adjusted, for example, in accordance with the thickness and the surface state of sheets. Hence, such a mechanism is very suitable, for example, when separating and feeding sheets at high speed, or when durability is required.

In the above-described configuration, however, malfeeding of a sheet or simultaneous feeding of multiple sheets may occur, if the adjustment of the separation force of inversely-rotating roller 102 by changing the amount of overlap between feeding roller 101 and inversely-rotating roller 102 is inadequate. Conventionally, since the adjustment is manually performed, only a skilled operator can perform correct adjustment.

The above-described configuration also has the problem that it is impossible to sequentially feed sheets from a bundle of sheets having different thicknesses.

SUMMARY OF THE INVENTION

It is an object of the present invention to provide a sheet feeding device which can securely separate and feed any sheets by automatically adjusting an optimum separation force.

It is another object of the present invention to provide a sheet feeding device which can individually separate and feed sheets securely from even a bundle of sheets having different characteristics (for example, thicknesses, or coefficients of friction of surfaces).

According to one aspect, the present invention which achieves these objectives relates to a sheet feeding device comprising a feeding rotating member having a plurality of large-diameter portions and rotating in a direction for moving a sheet in a sheet-feeding direction, an inversely rotating member having a plurality of large-diameter portions alternately disposed with respect to the large-diameter portions of the feeding rotating member and rotating in a direction tending to move a sheet in a direction inverse to the sheet-feeding direction, and automatic adjustment means for automatically adjusting an amount of overlap between the large-diameter portions of the feeding rotating member and the large-diameter portions of the inversely rotating member in accordance with a sheet-feeding state.

The adjustment means adjusts the amount of overlap, for example, in accordance with the load of a sheet entering between the feeding rotating member and the inversely rotating member, or based on detection by thickness detection means for detecting the thickness of a sheet, or based on detection of sheet detection means, disposed at a side downstream from the feeding rotating member in the sheet-feeding direction, for detecting a sheet separated by the feeding rotating member and the inversely rotating member.

As described above, in the present invention, since an optimum separation force corresponding to the state of a sheet (for example, the thickness of the sheet, or the coefficient of friction of the surface of the sheet) can be obtained by adjusting the amount of overlap between the feeding rotating member and the inversely rotating member based on the load of the sheet while being conveyed, the thickness of the sheet, or the detection of the sheet-feeding state, it is possible to securely separate and feed sheets, and automatically adjust the amount of overlap. Hence, even an unskilled operator can easily operate the device.

In addition, since the amount of overlap is automatically adjusted for each sheet so that the sheet can be appropriately separated and fed, even a bundle of sheets having different thicknesses and different coefficients of friction of the surfaces can be efficiently fed.

According to another aspect of the present invention, a sheet feeding device includes a feeding rotating member, an inversely rotating member and adjustment means. The feeding rotating member has a plurality of large-diameter portions and rotates in a direction for moving a sheet in a sheet-feeding direction. The inversely rotating member has a plurality of large-diameter portions alternately disposed with respect to the large-diameter portions of the feeding rotating member and rotates in a direction tending to move a sheet in a direction reverse to the sheet-feeding direction. The adjustment means adjusts an amount of overlap between the large-diameter portions of the feeding rotating member and the large-diameter portions of the inversely rotating member in accordance with a load of a sheet entering between the feeding rotating member and the inversely rotating member.

According to a further aspect of the present invention, a sheet feeding device includes a feeding rotating member, an inversely rotating member, sheet detection means and adjustment means. The feeding rotating member has a plurality of large-diameter portions and rotates in a direction for moving a sheet in a sheet-feeding direction. The inversely rotating member has a plurality of large-diameter portions alternately disposed with respect to the large-diameter portions of the feeding rotating member and rotates in a direction tending to move a sheet in a direction reverse to the sheet-feeding direction. The sheet detection means is disposed at a side downstream from the feeding rotating member in the sheet-feeding direction and detects a sheet separated by the feeding rotating member and the inversely rotating member. The adjustment means adjusts an amount of overlap between the large-diameter portions of the feeding rotating member and the large-diameter portions of the inversely rotating member based on detection of the sheet by the sheet detection means.

According yet another aspect of the present invention, a sheet feeding device includes a feeding rotating member, an inversely rotating member, sheet-thickness detection means and adjustment means. The feeding rotating member has a plurality of large-diameter portions and rotates in a direction for moving a sheet in a sheet-feeding direction. The inversely rotating member has a plurality of large-diameter portions alternately disposed with respect to the large-diameter portions of the feeding rotating member and rotates in a direction tending to move a sheet in a direction reverse to the sheet-feeding direction. The sheet-thickness detection means detects the thickness of a sheet separated by the feeding rotating member and the inversely rotating member. The adjustment means adjusts an amount of overlap between the large-diameter portions of the feeding rotating member and the large-diameter portions of the inversely rotating member based on detection of the thickness of the sheet by the sheet-thickness detection means.

According to still a further aspect of the present invention, a sheet feeding device includes a feeding rotating member, an inversely rotating member, adjustment means, mode setting means and separation-position storage means. The feeding rotating member has a plurality of large-diameter portions and rotates in a direction for moving a sheet in a sheet-feeding direction. The inversely rotating member has a plurality of large-diameter portions alternately disposed with respect to the large-diameter portions of the feeding rotating member and rotates in a direction tending to move a sheet in a direction reverse to the sheet-feeding direction. The adjustment means adjusts an amount of overlap between the large-diameter portions of the feeding rotating member and the large-diameter portions of the inversely rotating member. The mode setting means sets a separation adjusting mode in which separation adjustment between the feeding rotating member and the inversely rotating member is performed for each sheet, and a fixing mode in which separation adjustment is not performed for each sheet. The separation-position storage means stores the amount of overlap. When the separation adjusting mode has been set by the mode setting means, adjustment control of the amount of overlap is performed for each sheet, and when the fixing mode has been set by the mode setting means, adjustment is performed based on the amount of overlap stored in the separation-position storage means.

Further aspects of the present invention include an image reading apparatus employing any of the sheet feeding devices described above as well as a reading device for reading an image formed on a sheet individually separated by the feeding rotating member and the inversely rotating member.

DETAILED DESCRIPTION OF THE PREFERRED EMBODIMENTS

A description will now be provided of a sheet feeding device according to a first embodiment of the present invention with reference to the drawings.

Figure 1:
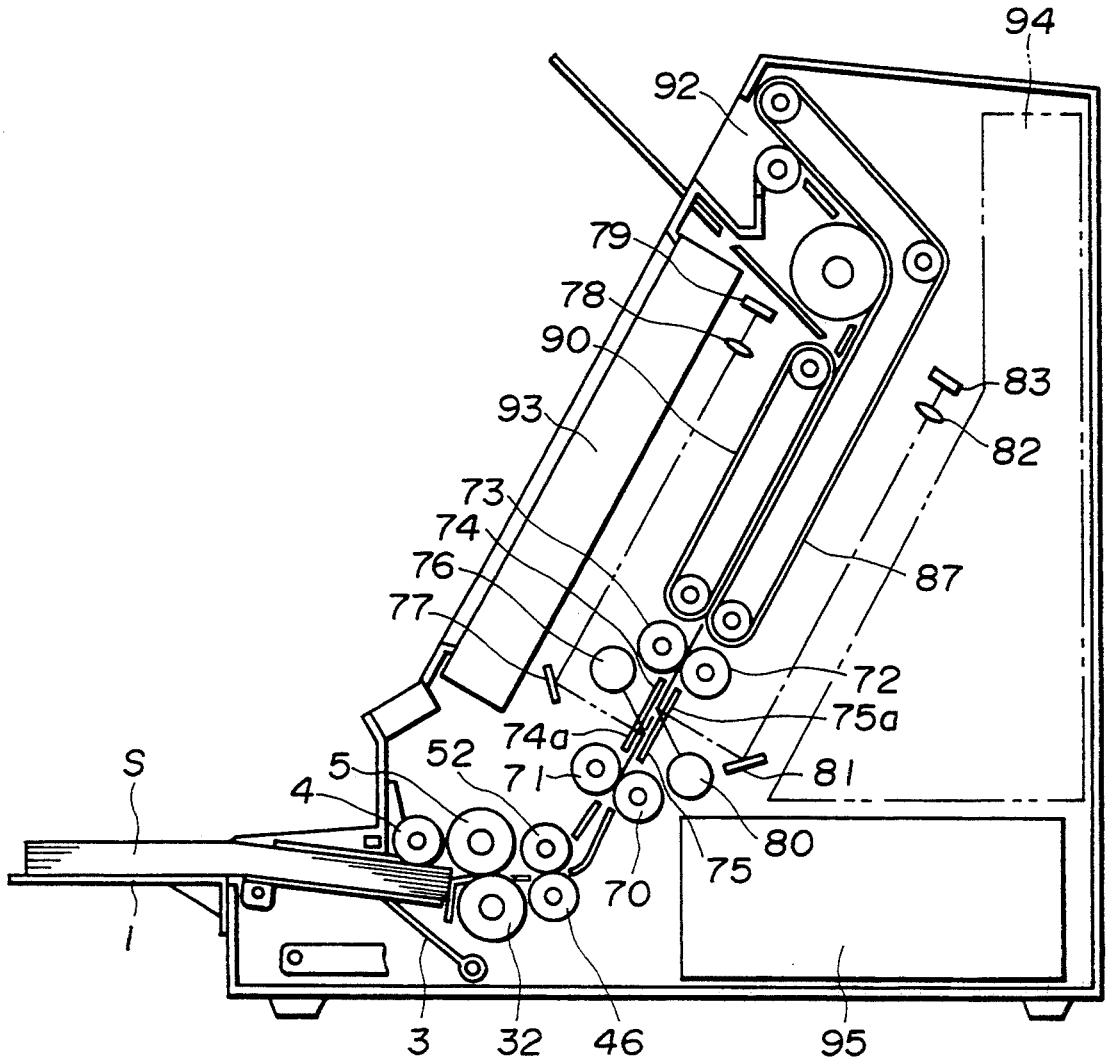
FIG. 1 is a longitudinal sectional side view of an image reading apparatus to which a sheet feeding device according to a first embodiment of the present invention is applied.

FIG. 1 is a schematic cross-sectional view illustrating an image reading apparatus to which the sheet feeding device of the first embodiment is applied.

In this apparatus, each sheet of mounted originals S is fed to the apparatus, images on the two surfaces of the fed sheet are read, the read images are displayed on a display device, and at the same time the images are recorded in a recording device. The apparatus also has the function of retrieving an image recorded in the recording device and displaying the retrieved image on the display device.

In FIG. 1, sheet-feeding roller 4 feeds respective sheets of originals S on an original mount to the apparatus. Each of comb-like rollers 5 and 32 has large-diameter portions and a small-diameter portion. The large-diameter portions of one of the rollers 5 and 32 are arranged to face the small-diameter portion of the other roller, and vice versa. By driving comb-like rollers 5 and 32 in the forward direction and the reverse direction with respect to the original-feeding direction, respectively, sheets of originals S fed by sheet-feeding roller 4 are individually separated, and each of the separated sheets is fed to the apparatus.

Each individually fed sheet of original S is conveyed by a pair of conveying rollers 46 and 52, and is further conveyed while being grasped by a pair of conveying rollers 70 and 71, and a pair of conveying rollers 72 and 73 rotating at a constant speed. At that time, the two surfaces of the sheet of original S are illuminated by light sources 76 and 80 through transparent members 74*a* and 75*a* provided at guide plates 74 and 75, respectively. The images on the two surfaces of the sheet of original S are imaged onto image reading sensors 79 and 83, such as CCD's (charge-coupled devices) or the like, by plane mirrors 77 and 81, and imaging lenses 78 and 82, respectively. Thus, the images on the two surfaces of the sheet of original S are read.

The read images are displayed on display device 93, and at the same time the images are recorded in recording device 95, such as a magnetooptical-disk device or the like.

The image of original S recorded in recording device 95 can be retrieved, whenever needed, and displayed on display device 93.

The read sheet of original S is grasped by conveying belts 87 and 90, and is discharged onto sheet-discharging unit 92.

Reference numeral 94 represents an electric-component unit, which includes a power supply, a control substrate and the like, for controlling the apparatus to perform the above-described operations.

The outline of the apparatus has now been described.

Figure 2:
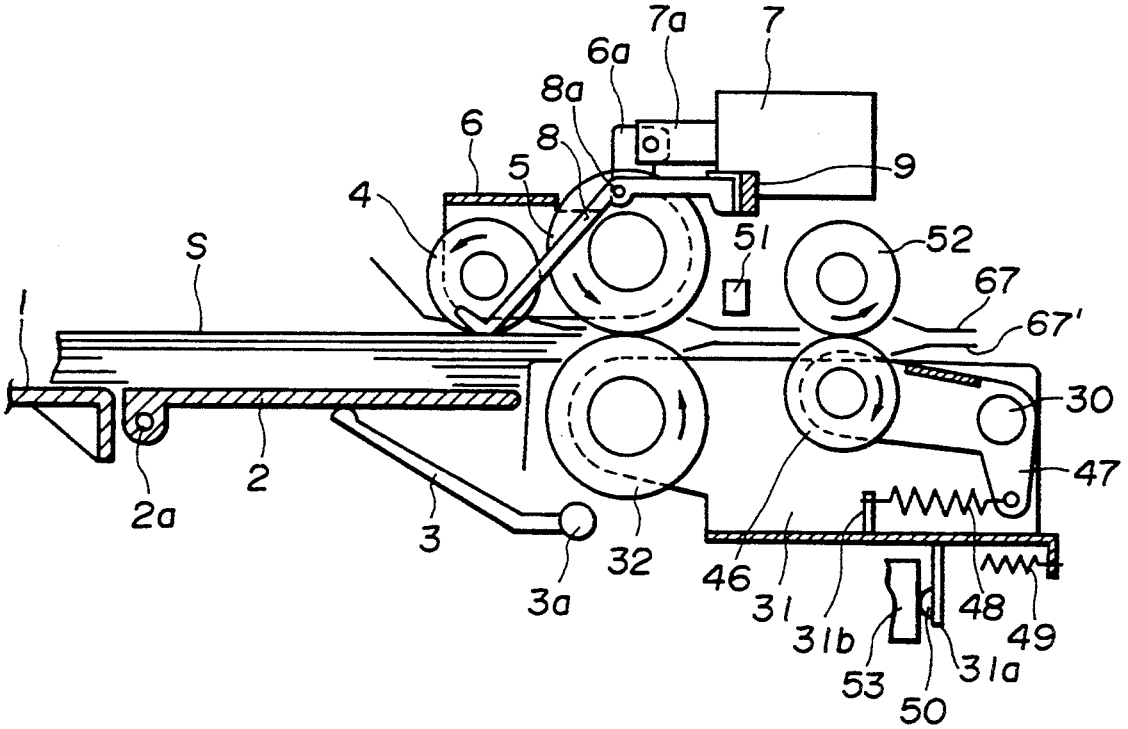
FIG. 2 is a longitudinal sectional side view of the sheet feeding device of the first embodiment.
Figure 3:
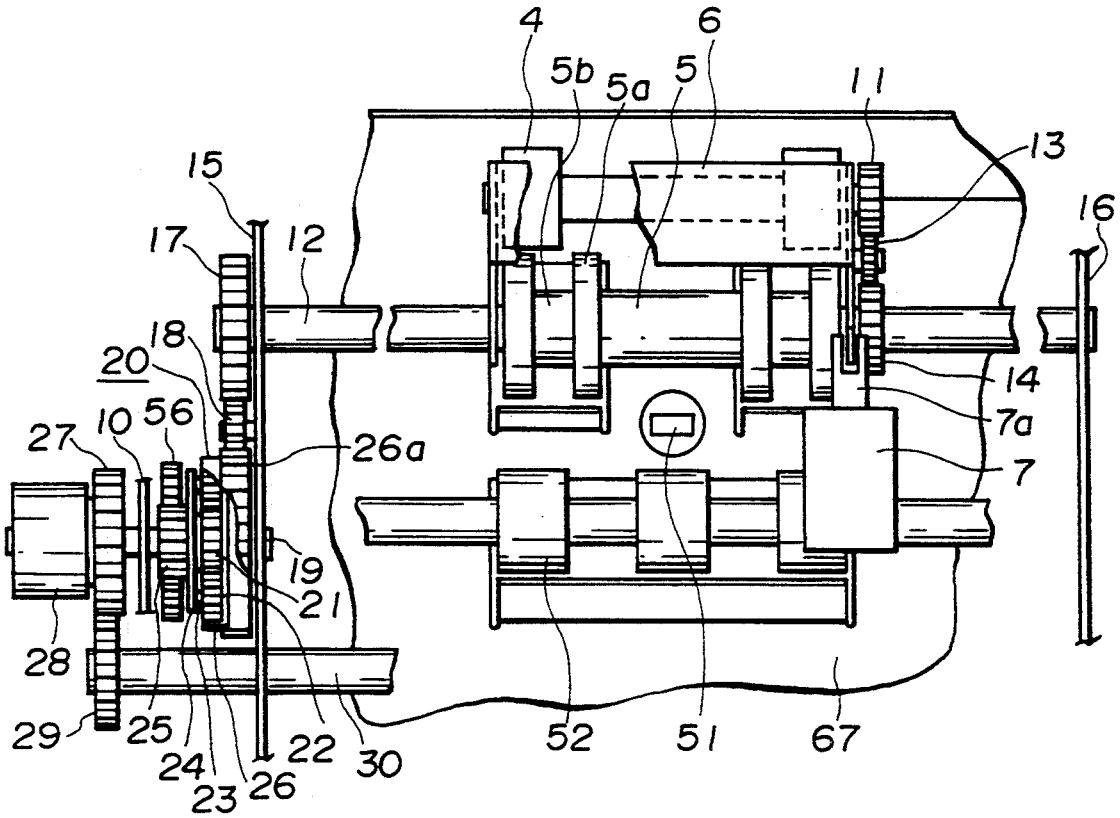
FIG. 3 is a plan view of the sheet feeding device of the first embodiment.

FIG. 2 is a cross-sectional view illustrating the sheet feeding device of the present embodiment, and FIG. 3 is a plan view of the device. In FIG. 2, there are shown tray 1 for mounting originals, original mount 2 which is rotatably mounted around shaft 2*a*, and original-mount raising lever 3 which is rotatable around shaft 3*a*.

Sheet-feeding roller 4 is rotatably mounted on U-shaped member 6 which is rotatably mounted around shaft 12. Solenoid 7 is mounted at one end portion 6*a* of U-shaped member 6 via plunger 7*a*.

Comb-like roller 5 (hereinafter termed a "feeding roller"), which has large-diameter portions 5*a* and a small-diameter portion 5*b*, is mounted on shaft 12, which is rotatably supported at side plates 15 and 16, as one body. Gears 14 and 17 are mounted on shaft 12. Gear 14 is linked with gear 11, which is mounted at one end of sheet-feeding roller 4, via gear 13.

Figure 4:
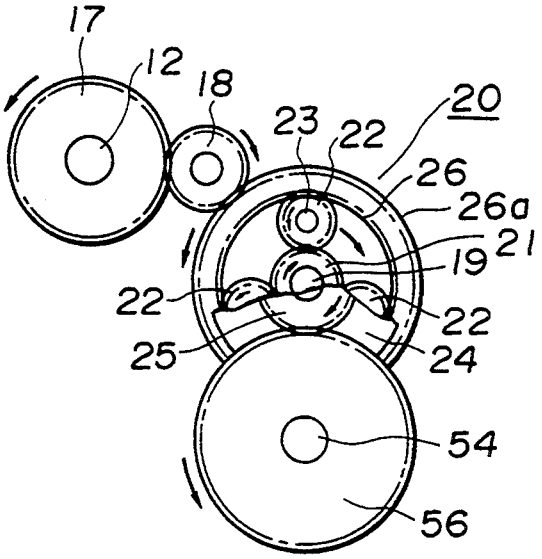
FIG. 4 is a front view illustrating a driving system.

As shown in FIG. 4, planetary-gear device (differential mechanism) 20 includes a sun gear 21, an internal gear 26, and planetary gears 22, each of which is rotatably mounted on one of shafts 23 secured on carrier 24 and which meshes with sun gear 21 and internal gear 26.

Sun gear 21 is mounted on shaft 19, which is rotatably supported by side plates 10 and 15, as one body. Internal gear 26 is rotatably mounted on shaft 19, and has gear teeth 26*a* at its outer circumference. Gear teeth 26*a* are linked with gear 17 via gear 18.

Gear 25 is mounted on carrier 24, which includes planetary gear 22, as one body so as to be rotatable around shaft 19.

Gear 27 is mounted on shaft 19 via clutch 28. Gear 27 meshes with gear 29 which is mounted on shaft 30.

Original-detection sensor 9 detects the presence/absence of the sheet of original S using lever 8 which rotates around shaft 8*a*. The upper surface of original S is controlled so as to be always present at a predetermined position based on a signal from sensor 9.

Fed-sheet sensor 51 and conveying roller 52 is rotatably driven via clutches (not shown). Reference numerals 67 and 67' represent guide plates for guiding the sheet of original S.

Figure 5:
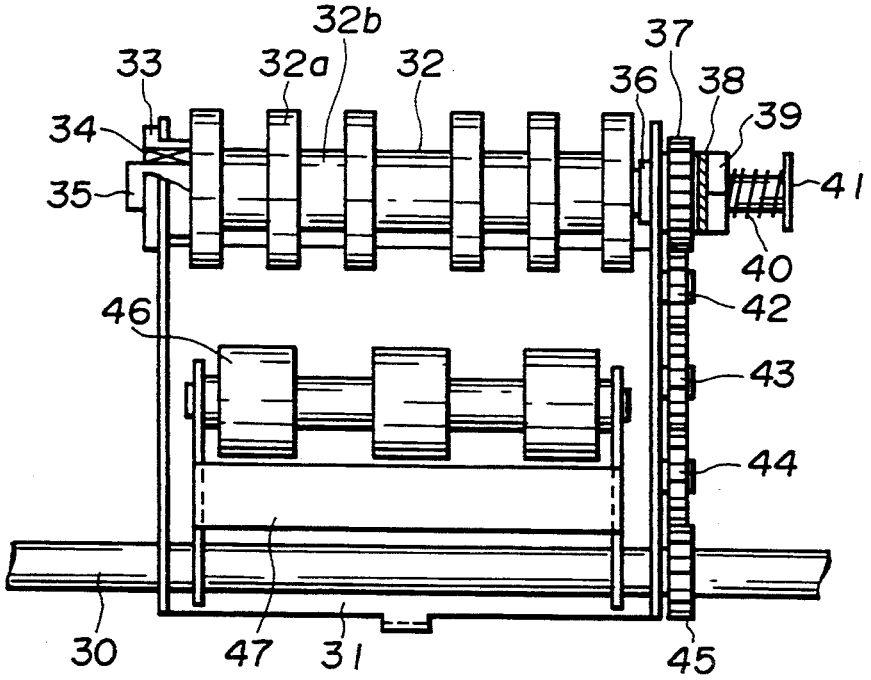
FIG. 5 is a plan view illustrating a mounting unit for an inversely-rotating roller.

As shown in FIG. 5, comb-like roller 32 (hereinafter termed an "inversely-rotating roller"), which has large-diameter portions 32*a* and a small-diameter portion 32*b*, is mounted on shaft 35 as one body. One end of shaft 35 is supported by bearing 36, and another end of shaft 35 is supported by bearing 33 via one-way clutch 34 for transmitting the driving force only in the direction of the arrow shown in FIG. 2. Shaft 35 is rotatably mounted on U-shaped member 31.

Feeding roller 5 and inversely-rotating roller 32 are disposed so that the large-diameter portions of one of the rollers face the small-diameter portion of the other roller.

Gear 37 is rotatably mounted on shaft 35, and member 39 is mounted on shaft 35 as one body so as to be movable only in the thrust direction. Member 39 is pressed against gear 37 by spring 40 via frictional member 38. Stopper 41 for blocking spring 40 is provided as one body with shaft 35. According to the above-described configuration, if a load having at least a predetermined value is applied to inversely-rotating roller 32, a slip is produced between frictional member 38 and gear 37 to disconnect the transmission of the driving force to inversely-rotating roller 32. Gear 37 is linked with gear 45, which is mounted on shaft 30, via gears 44, 43 and 42, which are provided on U-shaped member 31.

Conveying roller 46 is rotatably mounted on U-shaped member 47. U-shaped member 47 is rotatably mounted on shaft 30. One end of U-shaped member 47 is driven in a clockwise direction by spring 48 which is mounted on raised member 31*b* of U-shaped member 31. That is, conveying roller 46 is pressed against conveying roller 52 with a predetermined force.

U-shaped member 31 is rotatably mounted on shaft 30, and is driven in a clockwise direction by spring 49. Semicircular member 50 is provided on raised member 31*a* of U-shaped member 31. Semicircular member 50 contacts inclined portion 53*a* (see FIG. 6) of member 53 so as to regulate the position of inversely-rotating roller 32.

Figure 6:
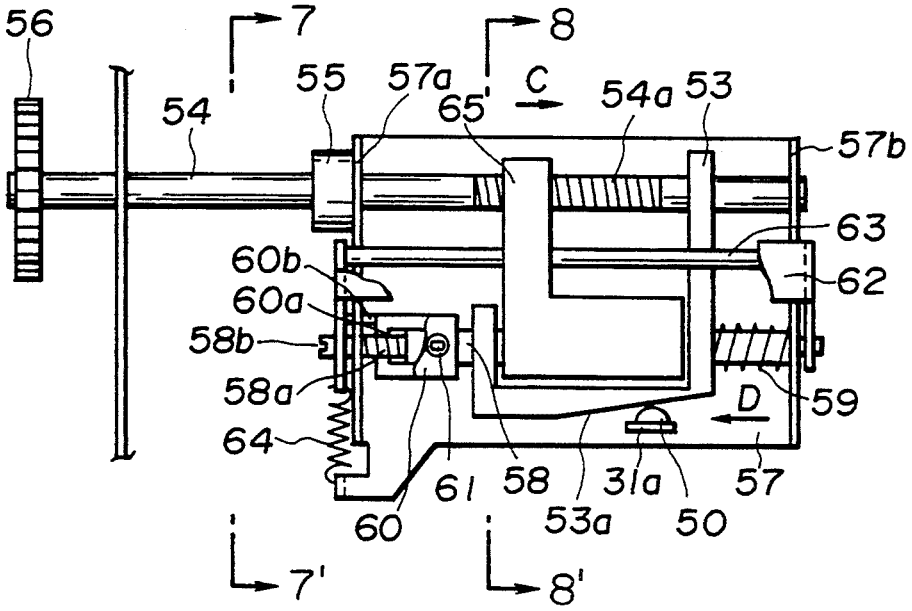
FIG. 6 is a plan view illustrating a mechanism for adjusting the distance between shafts.

FIG. 6 is a plan view illustrating a mechanism for regulating the position of inversely-rotating roller 32.

Figure 7:
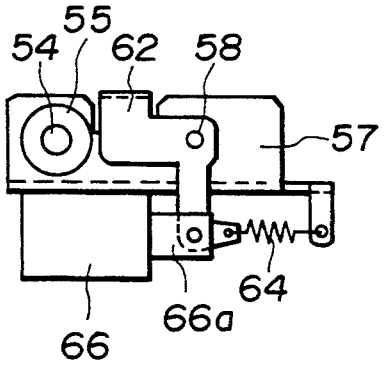
FIG. 7 is a cross-sectional view taken along line 7—7' shown in FIG. 6.
Figure 8:
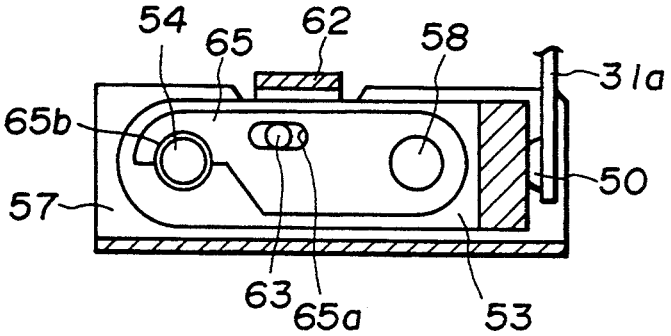
FIG. 8 is a cross-sectional view taken along line 8—8 shown in FIG. 6.
Figure 9:
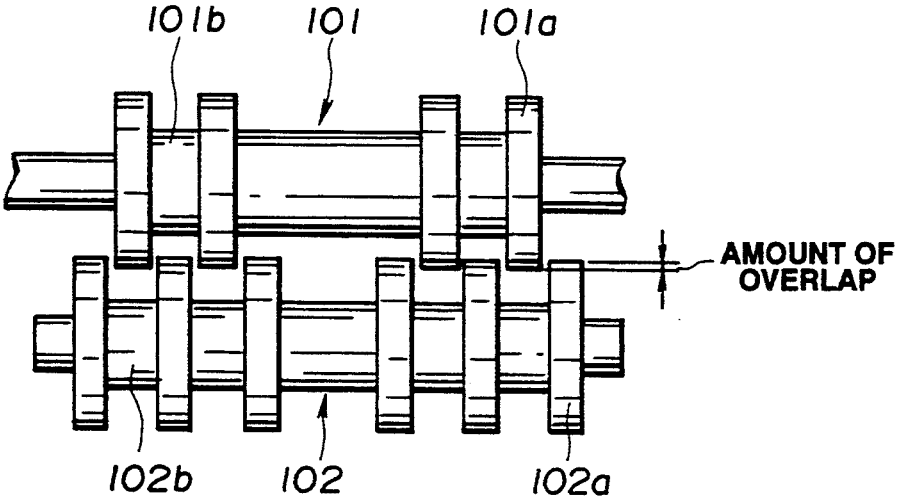
FIG.9 (PRIOR ART)
FIG. 9 is a front view illustrating the mounted position of a feeding roller and an inversely-rotating roller in a conventional sheet feeding device.

FIG. 7 is a cross-sectional view of the mechanism taken along line 7—7' shown in FIG. 6. FIG. 8 is a cross-sectional view of the mechanism taken along line 8—8' shown in FIG. 6.

Shaft 54, which has screwed portion 54*a* at a part thereof, is rotatably mounted at side plates 57*a* and 57*b* of base 57. Gear 56 is mounted at one end of shaft 54. A load having a predetermined value is applied to carrier 24 by torque limiter 55 via gear 56.

Inclined member 53 having inclined portion 53*a* is slidably mounted on cylindrical portions of shafts 58 and 54, which are mounted at side plates 57*a* and 57*b* of base 57.

Laterally-moving member 65, which includes semicircular screwed portion 65*b* fitted to screwed portion 54*a* of shaft 54, is rotatably mounted on shaft 58.

Release lever 62 is rotatably mounted on shaft 58. Solenoid 66 is mounted on release lever 62 via plunger Shaft 63, which is fitted in slot 65*a* of laterally-moving member 65, is also mounted on release lever 62. Release lever 62 is driven in a counterclockwise direction (see FIG. 7) by spring 64, one end of which is mounted on base 57. Accordingly, semcircular screwed portion 65*b* of laterally-moving member 65 is pressed against screwed portion 54*a* of shaft 54 by shaft 63.

Shaft 58 has screwed portion 58*a*, and screwed portion 60*a* of stopper 60, which is fitted to shaft 58, is screwed to screwed portion 58*a*.

Stopper 60 has projection 60*b* which is fitted in a hole (not shown) provided at side 57*a* of base 57. By turning slot 58*b* provided at an end portion of shaft 58 with a driver, stopper 60 can be moved in the axial direction. Stopper 60 is fixed to the shaft by setscrew 61.

Spring 59 is provided around the outer circumference of shaft 58, and drives member 53 so that it is pushed toward stopper 60 (direction D).

Next, the operation of the present embodiment will be desribed.

When a switch (not shown) has been depressed to start a recording operation, original-mount raising lever 3 rotates around shaft 3*a* to rotate original mount 2 in a counterclockwise direction.

When the surface of the uppermost sheet of originals S on original mount 2 has contacted original-detection sensor lever 8 and original detection sensor 9 has then detected another end of original-detection sensor lever 8, original-mount raising lever 3 stops to rotate. At the same time, power supply for solenoid 7 is interrupted, and U-shaped member 6 rotates in a counterclockwise direction by its own weight, so that sheet-feeding roller 4 contacts the surface of the uppermost sheet of originals S.

Then, clutch 28 operates to link gear 27 with shaft 19. The driving force is thereby transmitted from gear 29 to gear 27 and to sun gear 21 of the sun-gear device. Since carrier 24 is stopped due to the load of torque limiter 55, the driving force is further transmitted to planetary gear 22, to internal gear 26, and to gear 17 by gear teeth 26*a* of internal gear 26 via gear 18. Feeding roller 5 and sheet-feeding roller 4 thereby rotate to feed sheets of originals S into the apparatus. At that time, sheets after the second sheet of originals S are blocked by inversely-rotating roller 32, and the uppermost sheet of original S mounted on original mount 2 is separated and fed.

The sheet of original S separated by feeding roller 5 and inversely-rotating roller 32 is fed to a nip portion between the pair of conveying rollers 52 and 46.

When the leading end of the sheet of original S has been detected by fed-sheet sensor 51, power is supplied to solenoid 7 to rotate U-shaped member 6 in a clockwise direction, whereby sheet-feeding roller 4 is separated from the surface of the sheet. When the leading end of the sheet of original S has reached the nip portion between the pair of conveying rollers 52 and 46, clutch 28 is disconnected, whereby feeding roller S stops to rotate.

A clutch (not shown) is then operated with an appropriate timing, the driving force is transmitted to conveying roller 52, and the sheet of original S is fed to the following step while being grasped by the pair of conveying rollers 52 and 46. Thereafter, the above-described image processing operation is performed.

When the trailing end of the sheet of original S has been detected by fed-sheet sensor 51, power supply for solenoid 7 is interrupted with an appropriate timing, whereby U-shaped member 6 rotates in a counterclockwise direction by its own weight, so that sheet-feeding roller 4 contacts the surface of the uppermost sheet of originals S. Then, clutch 28 operates, so that sheet-feeding roller 4 and feeding roller 8 again rotate to feed the sheet of the next original S into the apparatus.

When sheets of originals S have been sequentially fed by the above-described operation, the position of the surface of originals S has descended, and original-detection sensor lever 8 in contact with the surface of the uppermost sheet of originals S has rotated in a counterclockwise direction and left original detection sensor 9, original-mount raising lever 3 rotates to raise original mount 2. When original detection sensor 9 has detected original-detection sensor lever 8, original-mount raising lever 3 stops. By detecting the position of the surface of originals S by original detection sensor 9 in the above-described manner, the position of the surface of originals S is always maintained at a constant position.

If the thickness of originals S is greater than the amount of overlap between feeding roller 5 and inversely-rotating roller 32 required for obtaining an appropriate separation force, a large load is applied to feeding roller 5. If the value of this load is greater than the value of the load set by torque limiter 55, feeding roller 5 and sheet-feeding roller 4 linked therewith stop, and internal gear 26 of planetary-gear device 20 also stops. On the other hand, carrier 24 which has been kept stopped starts to rotate, therefore gear 25 starts to rotate in a clockwise direction, and shaft 54 starts to rotate in a counterclockwise direction by gear 56 which meshes with gear 25 (see FIG. 4).

Laterally-moving member 65 screwed to screwed portion 54*a* of shaft 54 is thereby moved in the direction of arrow C shown in FIG. 6 together with member 53. Semicircular member 50 contacting the inclined portion of member 53 is thereby pushed, to rotate U-shaped member 31 in a counterclockwise direction in FIG. 2. Accordingly, the distance between the shafts of inversely-rotating roller 32 and feeding roller 5 increases, and the amount of overlap of the rollers is reduced.

The load of originals S applied to feeding roller 5 is thereby reduced. If the value of this load becomes smaller than the value of the load set by torque limiter 55, carrier 24 of planetary-gear device 20 stops to rotate, and internal gear 26 starts to rotate by planetary gear 22 provided in carrier 24. Feeding roller 5 and sheet-feeding roller 3 thereby start to rotate again to feed sheets of originals S.

By arranging so that the drive of sheet-feeding roller 4 is linked with feeding roller 5, sheet-feeding roller 4 also stops when feeding roller 5 stops. Hence, it is possible to overcome the problem that the sheet-feeding roller feeds originals while the feeding roller stops, causing a jam of an original.

In an initial state, the distance between the shafts of feeding roller 5 and inversely-rotating roller 32 is set to a minimum value so that an appropriate separation force can be obtained for the thinnest set originals.

In this state, inclined member 53 contacts stopper 60.

The position of initial setting is provided by rotating shaft 58 to move stopper 60 in the axial direction (see FIGS. 6, 7 and 8).

When the trailing end of the sheet of original S has been detected by fed-sheet sensor 51, power is supplied to solenoid 66 to rotate release lever 62 in a clockwise direction in FIG. 7 against spring 64. Laterally-moving member 65 thereby rotates in a clockwise direction in FIG. 8 by shaft 63 provided at release lever 62, and leaves screwed portion 54*a*. Laterally-moving member 65 which moved to an arbitrary position in direction C in accordance with the thickness of originals S is returned in direction D by spring 59 together with inclined member 53 until it contacts stopper 60. The distance between the shafts of feeding roller 5 and inversely-rotating roller 32 returns to the initial state.

Even if the thickness of originals S mounted on original mount 2 differs, the distance between the shafts of feeding roller 5 and inversely-rotating roller 32 is adjusted so that a separation force corresponding to the thickness is obtained, and sheets of originals S are individually separated and fed.

Although in the above-described embodiment a releasing operation of returning the distance between the shafts of feeding roller 5 and inversely-rotating roller 32 to the original state is performed for each original, the releasing operation may be performed after the completion of feeding of mounted originals at least when the mounted originals have the same thickness.

Figure 10:
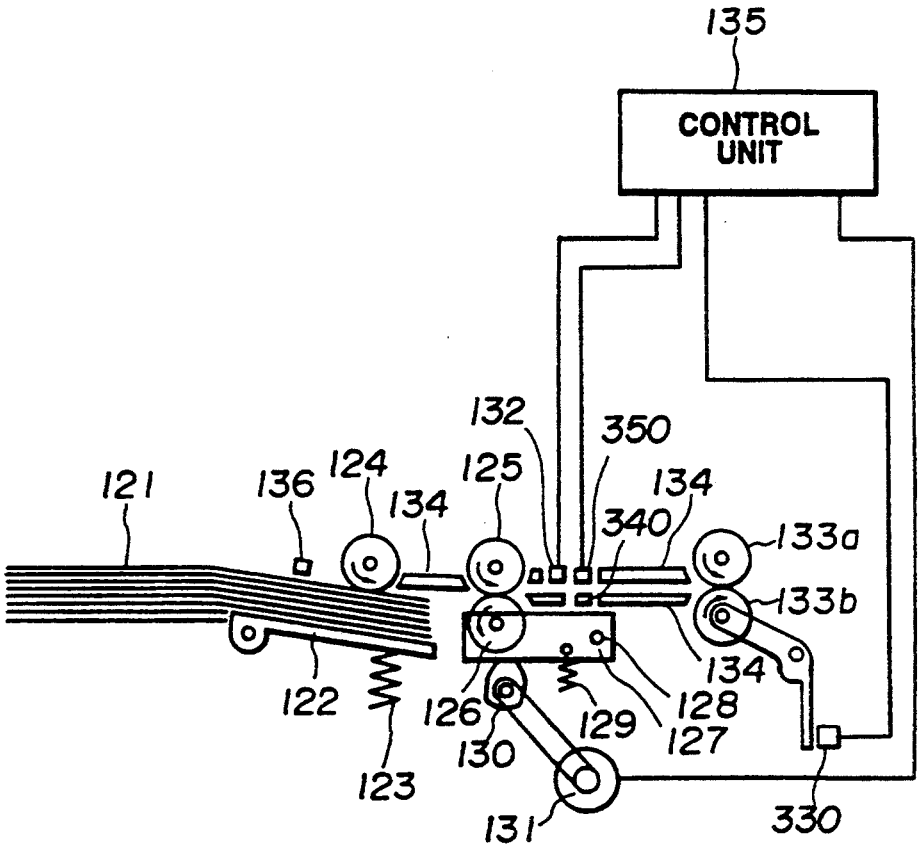
FIG. 10 is a longitudinal sectional side view of a sheet feeding device according to a second embodiment of the present invention.

FIG. 10 illustrates a second embodiment of the present invention.

When sheets of originals 121 have been mounted on original mount 122 and a start key (not shown) has been depressed, sensor 136 confirms the presence/absence of originals. When the presence of originals has been confirmed, respective rollers are driven. The originals pressed against sheet-feeding roller 124 by spring 123 are fed toward feeding roller 125 and separation roller 126 in the following stage by friction between the originals and sheet-feeding roller 124.

Feeding roller 125 and separation roller 126 rotate in respective directions indicated by the corresponding arrows. Feeding roller 125 tends to feed the uppermost sheet of originals 121 to the subsequent roller, and separation roller 126 tends to return sheets under the second sheet of originals 121 (other than the uppermost sheet).

Separation roller 126 is supported by separation-roller support (moving means) 127, which is rotatable around fulcrum 128, is driven downwardly by spring 129, and is supported upwardly by eccentric cam 130. Eccentric cam 130 is rotated by driving motor 131 via a belt.

In the above-described configuration, when starting to feed the sheet of original 121, eccentric cam 130 is arranged so that its separation unit is at an upper position (a first position which is close to feeding roller 125). Even if the sheet of original 121 is fed in this state, the sheet cannot pass between feeding roller 125 and separation roller 126 since the space between these rollers is narrow. Therefore, the sheet of original 121 is not detected by sensor 132.

Then, motor 131 is rotated to rotate eccentric cam 130, whereby separation roller 126 is lowered by a predetermined amount. This operation is continued until sensor (detection means) 132 detects the sheet of original 121. When the sheet of original 121 has been detected, motor 131 is stopped to fix the position of separation roller 126, and the sheet of original 121 continues to be fed.

Figure 11:
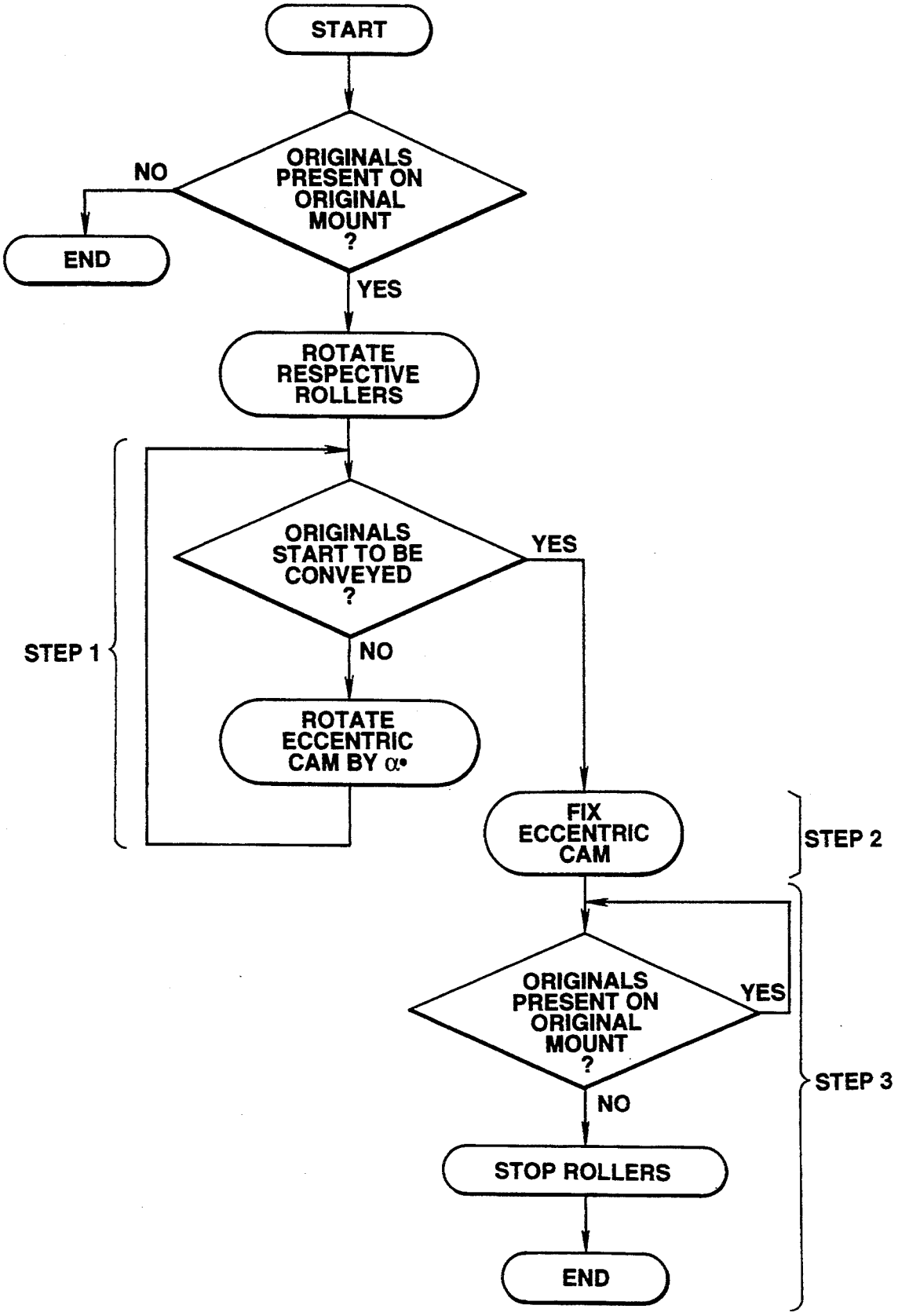
FIG. 11 is a flowchart for the sheet feeding device of the second embodiment.

FIG. 11 is a flowchart of the present embodiment.

When sheets of originals 121 have been mounted on original mount 122 and the start key has been depressed, sensor 136 confirms the presence/absence of originals. When the presence of originals has been confirmed, the respective rollers are rotated, and separation roller 126 is lowered until the uppermost sheet of originals starts to be conveyed (step 1). When the original starts to be conveyed, eccentric cam 130 is fixed at the current position (step 2), and the originals are conveyed until no originals remain on original mount 122 while maintaining separation roller 126 at the current position (step 3).

As described above, by automatically adjusting the position of separation roller 126 when starting feeding of sheets of originals 121, each sheet of original 121 can be securely converted (a separation adjusting mode).

Although in the above-described second embodiment a description has been provided of only a case in which sheet feeding is started, the second embodiment can also be applied to other cases. For example, in a conventional apparatus, if the thickness of originals 121 is reduced from a certain sheet in one file, multiple sheets of thin originals are always fed. However, the occurrence of feeding of multiple sheets is minimized by linking separation roller 126 with multiple-sheet-feeding detection means, and by moving separation roller 126 upwardly upon detection of feeding of multiple sheets, thereby reducing the space between separation roller 126 and feeding roller 125.

When feeding sheets of originals 121 having the same thickness a plurality of times, separation-means-position storage means stores the position of separation roller 126 at the preceding time, or the position of separation roller 126 determined at the feeding of the first sheet in the present time, and a separation/feeding operation is performed by positioning separation roller 126 at the stored position without performing adjustment every time (separation fixing mode). According to such an approach, the time required for adjustment can be omitted, and therefore sheets of originals 121 can be efficiently fed. A mode is set by mode setting means (not shown).

In the above-described separation adjusting method, the space between separation roller 126 and feeding roller 125, which has been first adjusted to be narrow, is gradually increased, and sheets are fed with such a space that the first sheet can pass, However, the best space may, of course, be determined according to various factors. For example, a space which is more or less greater than the minimum space for passing a sheet may be preferred for originals 121, for example, depending on the material of the original, or the separation method.

Figure 12:
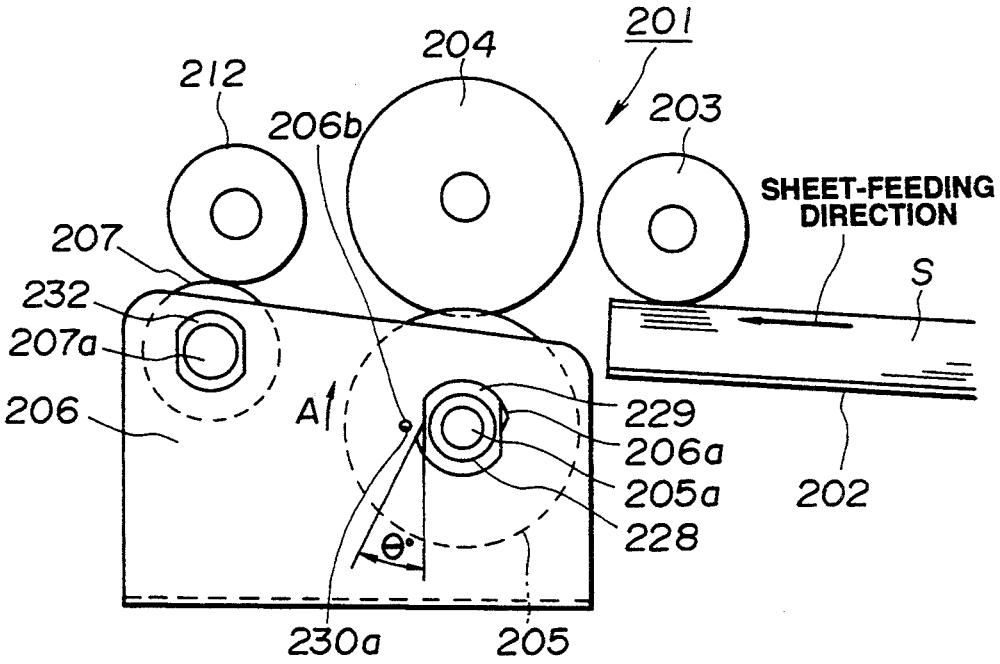
FIG. 12 is a side view illustrating the neighborhood of a feeding roller and a separation roller of a sheet feeding device according to a third embodiment of the present invention.
Figure 13:
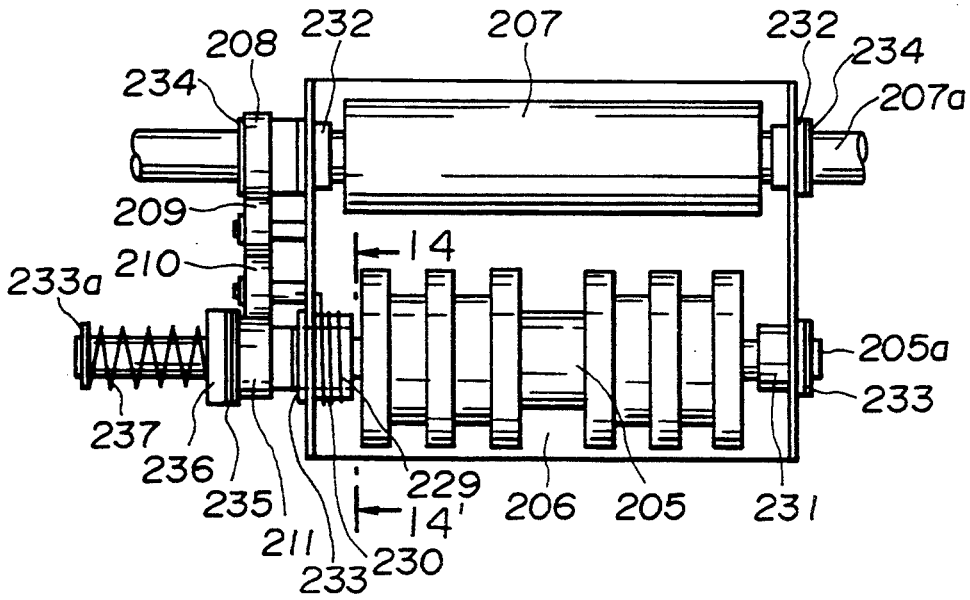
FIG. 13 is a plan view illustrating the neighborhood of the feeding roller and the separation roller shown in FIG. 12.
Figure 14:
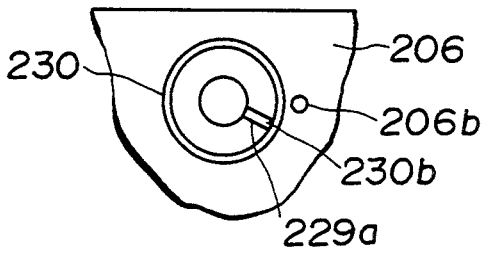
FIG. 14 is a cross-sectional view taken along line 14—14'shown in FIG. 13, as seen from the direction of the arrows.

FIGS. 12 and 13 are diagrams illustrating characteristics of a third embodiment of the present invention. FIG. 14 is a cross-sectional view taken along line 14—14' shown in FIG. 13.

In FIGS. 12 and 13, there are shown sheets of originals S, sheet feeding device 201, original-mounting plate 202 for mounting originals before recording, sheet-feeding roller 203 for feeding sheets of originals S on original mounting plate 202 toward the downstream side, feeding roller 204 for feeding the sheets of originals S fed by sheet-feeding roller 203 further to the downstream side, separation roller 205 which rotates in a direction A such that it contacts originals S while moving in a direction reverse to the original-feeding direction in order to prevent feeding of multiple sheets of originals S, separation-roller supporting member 206, and sheet-conveying roller 207. These rollers are driven by a driving system (not shown).

Gear 208 is fixed to shaft 207*a* of sheet-conveying roller 207. Intermediate gears 209 and 210 are provided next to gear 208. Gear 211 is rotatably provided on shaft 208*a* of separation roller 205, and is linked with intermediate gear 210. The rotation of sheet-conveying roller 207 is transmitted to gear 211 via gear 208, and intermediate gears 209 and 210.

Driven roller 212 is in pressure contact with sheet-conveying roller 207.

One-way clutch 228 is fitted to separation-roller shaft 205*a* so as to prevent separation roller 205 from rotating in a direction opposite to the direction of arrow A shown in FIG. 12.

Reference numeral 229 represents a housing for mounting one-way clutch 228 on separation-roller supporting member 206. Reference numeral 230 represents a torsion coil spring for applying a rotational force in the direction of arrow A shown in FIG. 12 to housing 229. One end 230*a* of torsion coil spring 230 is inserted in hole 206*b* provided in separation-roller supporting member 206, and another end of torsion coil spring 230 is anchored in groove 229*a* provided at the inner side of housing 229 (see FIG. 14). There are also shown bearing members 231 and 232, longitudinal-direction restricting members 233 and 234, frictional member 235, resin disk 236, and compression spring 237. These components constitute a torque limiter for disconnecting the transmission of the driving force when a predetermined amount of load is applied.

Figure 15:
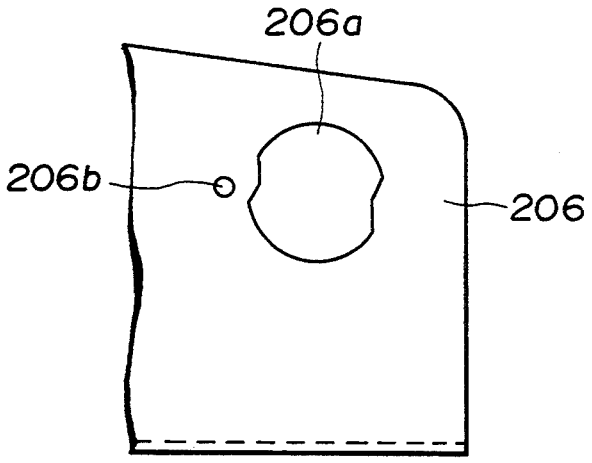
FIGS. 15 and 16 are front views of a mounting unit for the shaft of a separation roller of a separation-roller supporting member of the device of the third embodiment.

Hole 206*a* provided in separation-roller supporting member 206 has the shape shown in FIG. 15. By the function of torsion coil spring 230, housing 229 rotates by $\theta°$ in a counterclockwise direction from the state shown in FIG. 12 to assume the state shown in FIG. 16.

While sheet-conveying roller 207 rotates, separation roller 205 also rotates. Separation roller 205 stops only when a predetermined amount of load is applied to separation roller 205.

When a reading start switch (not shown) has been switched on, sheets of originals S on original-mounting plate 202 are fed by sheet-feeding roller 203. The fed sheets of originals S are individually separated by the pair of feeding roller 204 and separation roller 205, and each of the separated sheets is fed to the downstream side. Since no load is applied to separation roller 205 until sheets of originals S reach a nip portion between the pair of feeding roller 204 and separation roller 205, separation roller 205 rotates in the direction of arrow A shown in FIG. 12.

When originals S have reached the nip portion between the pair of feeding roller 204 and separation roller 205, separation roll 205 stops to rotate due to a load received from originals S. Originals S are further pushed toward the downstream side by sheet-feeding roller 203 and feeding roller 204, so that separation roller 205 intends to rotate in a direction reverse to the direction of arrow A.

When separation roller 205 rotates in the direction of arrow A, one-way clutch 228 is free, and therefore does not receive a rotational force from separation roller 205. However, when separation roller 205 intends to rotate in a direction reverse to the direction of arrow A, one-way clutch 228 is locked, and therefore intends to rotate in the same direction as separation roller 205.

Figure 16:
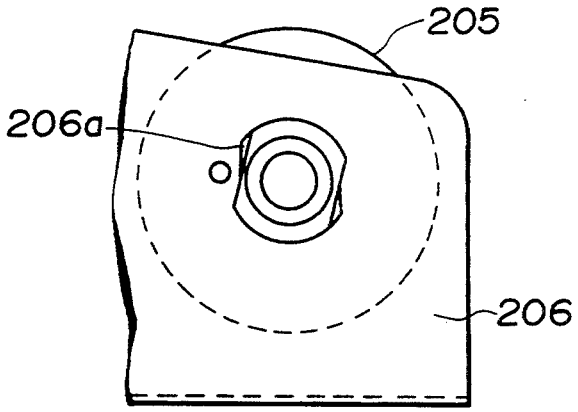

Accordingly, a rotational force is applied to housing 229, to which one-way clutch 228 is fitted, to rotate housing 229 by $\theta°$ from the state shown in FIG. 16 to the state shown in FIG. 12 against the action of torsion coil spring 230.

At that time, since separation roller 205 and one-way clutch 228 also rotate as one body with housing 229, separation roller 205 rotates in the original-feeding direction until the leading end of the sheet of original S reaches and then passes through the nip portion between the pair of feeding roller 204 and separation roller 205.

While the sheet of original S passes through the nip portion after housing 229 has assumed the state shown in FIG. 12, the sheet of original S intends to rotate separation roller 205 in a direction opposite to the direction of arrow A. Hence, housing 229 maintains the state shown in FIG. 12. Since separation roller 205 does not rotate in the original-feeding direction, feeding of multiple sheets of originals S do not occur.

When the trailing end of the sheet of original S has passed through the nip portion between feeding roller 204 and separation roller 205, the force applied from the sheet of original S to separation roller 205 disappears. Hence, housing 229 is returned to the state shown in FIG. 16 by the action of torsion coil spring 230.

Thereafter, the same operation is repeated every time the sheet of original S is fed. As in the conventional approach, images of the two surfaces of the sheet of original S passing through the pair of feeding roller 204 and separation roller 205 are read by an original-reading unit (not shown), and the sheet of original S is then discharged onto a sheet-discharging tray (not shown).

As described above, when each sheet of original S is separated and fed, separation roller 205 rotates in the original-feeding direction until the leading end of the sheet of original S reaches and passes through the nip portion between the pair of feeding roller 204 and separation roller 205. Hence, the leading end of the sheet of original S is prevented, for example, from being folded or raised even if the sheet is thin and has low stiffness, or the surface of the sheet is apt to be raised.

Furthermore, even if the space between the pair of feeding roller 204 and separation roller 205 is adjusted to be narrower than the thickness of the sheet of original S to be fed, the leading end of the sheet of original S does not stay at the entrance of the nip portion between the pair of feeding roller 204 and separation roller 205, as in the conventional approach, but enters the nip portion in accordance with the rotation of separation roller 205 in the sheet-feeding direction Hence, the sheet of original S can be fed.

Accordingly, the range of adjustment of the space between the pair of feeding roller 204 and separation roller 205 is much widened, and therefore it becomes easier to adjust the space between the pair of feeding roller 204 and separation roller 205 than in the conventional approach.

Next, a description will be provided of a fourth embodiment of the present invention.

In the above-described first and second embodiments, the amount of overlap between the feeding roller and the inversely-rotating roller is adjusted based on the load of the sheet, or the feeding state of the sheet. In the present embodiment, however, the thickness of the fed sheet is detected, and the amount of overlap is adjusted based on the result of the detection.

The present embodiment is effective when the thickness of each of sheets which have been mounted in order to be fed is substantially constant. That is, sheet-thickness detection means is disposed at a side downstream from separation means in order to detect the thickness of each separated sheet. The amount of overlap between the feeding roller and the inversely-rotating roller is first set to an average value. After separating the first sheet, the amount of overlap is adjusted to an optimum value based on the result of detection of the thickness of the separated sheet. Thus, each sheet after the next sheet is separated in an excellent manner.

Referring again to FIG. 10, in one embodiment the thickness of the sheet is detected, for example, by providing a pair of rollers 133*a*, 133*b* so as to be contactable and separable at a side downstream from the feeding roller 125, and means 330 for measuring the displacement of the rollers 133*a*, 133*b*, and by measuring the amount of displacement between the pair of rollers 133*a*, 133*b* when the sheet is inserted using measuring means. Alternatively, as shown in phantom therein, 340 a light-emitting unit for projecting light onto the sheet, and light-receiving unit 350 for receiving light passing through the sheet may be provided, and the thickness of the sheet may be detected based on the transmittance of the sheet.

A detection signal representing the thickness of the sheet detected by such sheet-thickness detection means is transmitted to a control unit 135. As in the above-described second embodiment, control means 135 adjusts the amount of overlap between the feeding roller and the inversely-rotating roller based on the detection signal.

Usually, the thickness of the sheet is proportional to the stiffness of the sheet, i.e., the stiffness increases as the thickness increases. Hence, it is necessary to set the amount of overlap between the feeding roller and the inversely-rotating roller to a small value for a thick sheet. That is, the amount of overlap is adjusted to a smaller value as the thickness of the sheet increases.

As a modification of the fourth embodiment, the amount of overlap between the feeding roller and the inversely-rotating roller may be adjusted directly based on the result of detection of the thickness of the sheet.

For example, a pair of rollers, which is linked with the inversely-rotating roller or the feeding roller, may be provided at a side downstream from the feeding roller, and the inversely-rotating roller or the feeding roller may be displaced by a linking mechanism or the like in accordance with the displacement of the pair of rollers corresponding to the thickness of the sheet. In this case, since the thickness of the sheet (the amount of displacement of the pair of rollers) is inversely proportional to the amount of overlap, the inversely-rotating roller or the feeding roller is moved so that the amount of overlap is reduced as the amount of displacement of the pair of rollers increases.

The present invention is not limited to the above-described embodiments. For example, the present invention is not limited to the method of separating sheets by the feeding roller and the inversely-rotating roller as in the above-described embodiments, but may also be applied to a method of separating sheets using a conveying belt. While in the above-described embodiments a description has been provided of the sheet feeding device for supplying originals to an electronic filing apparatus (an image reading apparatus), the present invention is not limited to such apparatuses, but may be applied to a sheet feeding device for feeding sheets to an image forming apparatus, such as a printer, a facsimile apparatus or the like, an original automatic feeding apparatus provided in a copier or an image reader, or the like.

The individual components shown in outline or designated by blocks in the drawings are well-known in the image conveying, recording and reading arts and their specific construction and operation are not critical to the operation or best mode for carrying out the invention.

While the present invention has been described with respect to what is currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and function.

What is claimed is:

1. A sheet feeding device comprising:

a feeding rotating member having a plurality of large-diameter portions and rotating in a direction for feeding a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction; and automatic adjustment means for automatically adjusting an amount of overlap between the large-diameter portions of said feeding rotating member and the large-diameter portions of said inversely rotating member in accordance with a load in a sheet-feeding direction of a sheet entering between said feeding rotating member and said inversely rotating member.

2. A device according to claim 1, wherein said automatic adjustment means gets the amount of overlap to a maximum before a sheet-feeding operation and then reduces the amount of overlap in accordance with the load of a sheet entering between said feeding rotating member and said inversely rotating member.

3. A device according to claim 2, wherein said automatic adjustment means comprises reset means for resetting the amount of overlap to the maximum after a sheet feeding operation.

4. A device according to claim 1 further comprising means for supporting said inversely rotating member so that said inversely rotating member can be rotated by a predetermined angle in the sheet-feeding direction when the sheet is fed by said feeding rotating member and said inversely rotating member.

5. A sheet feeding device comprising:

a feeding rotating member having a plurality of large-diameter portions and rotating in a direction for feeding a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction; and adjustment means for adjusting an amount of overlap between the large-diameter portions of said feeding rotating member and the large-diameter portions of said inversely rotating member in accordance with a load in the sheet-feeding direction of a sheet entering between said feeding rotating member and said inversely rotating member, said adjustment means comprising interval adjustment means for adjusting a distance between said feeding rotating member and said inversely rotating member in accordance with a driving force received from the sheet, a planetary-gear mechanism for switchably transmitting the driving force to one of said feeding rotating member and said interval adjustment means, and a torque limiter for applying a predetermined amount of load to said planetary-gear mechanism.

6. A device according to claim 5, wherein said adjustment means reduces the amount of overlap as the load of the sheet increases.

7. A device according to claim 6, wherein said adjustment means adjusts the amount of overlap by adjusting the distance between respective shafts of said feeding rotating member and said inversely rotating member.

8. A device according to claim 5, wherein when the load of the sheet is smaller than the load of said torque limiter, said planetary-gear mechanism transmits the driving force to said feeding rotating member, and when the load of the sheet is greater than the load of the torque limiter, said planetary-gear mechanism transmits the driving force to said interval adjustment means, which adjusts the amount of overlap.

9. A device according to claim 8, wherein said interval adjustment means comprises swingable supporting means for supporting one of said inversely rotating member and said feeding rotating member so that the one member is contactable and separable with respect to the other member, and moving means for contacting or separating said inversely rotating member and said feeding rotating member by swinging said supporting member when the driving force is transmitted from said planetary-gear mechanism.

10. A device according to claim 9, wherein said moving means comprises an inclined member which is advanced or retracted by the driving force, and moves said swingable supporting means by an inclined surface of said inclined member.

11. A sheet feeding device comprising:

a feeding rotating member having a plurality of large-diameter portions and rotating in a direction for moving a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

sheet detection means, disposed at a side downstream from said feeding rotating member in the sheet-feeding direction, for detecting a sheet separated by said feeding rotating member and said inversely rotating member; and adjustment means for adjusting an amount of overlap between the large-diameter portions of said feeding rotating member and the large-diameter portions of said inveresely rotating member based on detection of the sheet by said sheet detection means.

12. A device according to claim 11, wherein said adjustment means gradually reduces the amount of overlap until the sheet is detected, when said sheet detection means does not detect the sheet after start of feeding of the sheet.

13. A device according to claim 12, wherein said adjustment means adjusts the amount of overlap by adjusting the distance between respective shafts of said feeding rotating member and said inversely rotating member.

14. A device according to claim 13, wherein said adjustment means comprises swingable supporting means for supporting one of said inversely rotating member and said feeding rotating member so that the one member is contactable and separable with respect to the other member, a cam capable of swinging said swingable supporting means by rotating while contacting said supporting means, driving means for rotating said cam, and control means for controlling said driving means based on the detection by said sheet detection means.

15. A device according to claim 14, further comprising means for supporting said inversely rotating member so that said inversely rotating member can be rotated by a predetermined angle in the sheet-feeding direction when the sheet is fed by said feeding rotating member and said inversely rotating member.

16. A sheet feeding device comprising:

a feeding rotating member having a plurality of large-diameter portions and rotating in a direction for moving a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

sheet-thickness detection means for detecting the thickness of a sheet separated by said feeding rotating member and said inversely rotating member; and adjustment means for adjusting an amount of overlap between the large-diameter portions of said feeding rotating member and the large-diameter portions of said inveresely rotating member based on detection of the thickness of the sheet by said sheet-thickness detection means.

17. A device according to claim 17, wherein said adjustment means reduces the amount of overlap as the thickness of the sheet increases.

18. A device according to claim 17, wherein said sheet-thickness detection means comprises a pair of rollers and means for measuring a displacement of said rollers, wherein said sheet-thickness detection means detects the thickness of the sheet by said measuring means measuring an amount of displacement between said pair of rollers when the sheet is inserted.

19. A device according to claim 17, wherein said sheet-thickness detection means comprises a light-emitting unit for irradiating light onto the sheet and a light-receiving unit for receiving the light from said light-emitting unit, and detects the thickness of the sheet based on the light transmittance.

20. A sheet feeding device comprising:

a feeding rotating member having a plurality of large-diameter portions and rotating in a direction for moving a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

adjustment means for adjusting an amount of overlap between the large-diameter portions of said feeding rotating member and the large-diameter portions of said inversely rotating member;

mode setting means for setting a separation adjusting mode in which separation adjustment between said feeding rotating member and said inversely rotating member is performed for each sheet, and a fixing mode in which separation adjustment is not performed for each sheet; and separation-position storage means for storing the amount of overlap, wherein when the separation adjusting mode has been set by said mode setting means, adjustment control of the amount of overlap is performed for each sheet, and when the fixing mode has been set by said mode setting means, adjustment is performed based on the amount of overlap stored in said separation-position storage means.

21. A device according to claim 20 , wherein said separation-position storage means stores one of the amount of overlap during a sheet-feeding operation at a preceding time, and the amount of overlap during a first sheet feeding operation at a present time.

22. An image reading apparatus comprising:

a feeding rotating member having a plurality of large-diameter portions and rotating in a direction for feeding a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

automatic adjustment means for automatically adjusting an amount of overlap between the large-diameter portions of said feeding rotating member and the large-diameter portions of said inversely rotating member in accordance with a load in a sheet-feeding direction of a sheet entering between said feeding rotating member and said inversely rotating member; and reading means for reading an image formed on a sheet separated by said feeding rotating member and said inversely rotating member.

23. An image reading apparatus comprising:

a feeding rotating member having a plurality of large-diameter portions and rotating in a directing for feeding a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

adjustment means for adjusting an amount of overlap between the large-diameter portions of said feeding rotating member and the large-diameter portions of said inversely rotating member in accordance with a load in the sheet feeding direction of a sheet entering between said feeding rotating member and said inversely rotating member, said adjustment means comprising interval adjustment means for adjusting a distance between said feeding rotating member and said inversely rotating member in accordance with a driving force received from the sheet, a planetary-gear mechanism for switchably transmitting the driving force to one of said feeding rotating member and said interval adjustment means, and a torque limiter for applying a predetermined amount of load to said planetary-gear mechanism; and reading means for reading an image formed on a sheet separated by said feeding rotating member and said inversely rotating member.

24. An image reading apparatus comprising:

a feeding rotating member having a plurality of large-diameter portions and rotating in a direction for moving a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

sheet detection means, disposed at a side downstream from said feeding rotating member in the sheet-feeding direction, for detecting a sheet separated by said feeding rotating member and said inversely rotating member;

adjustment means for adjusting an amount of overlap between the large-diameter portions of said feeding rotating member and the large-diameter portions of said inveresely rotating member based on the detection of the sheet by said sheet detection means; and reading means for reading an image formed on the sheet individually separated by said feeding rotating member and said inversely rotating member.

25. An image reading apparatus comprising:

a feeding rotating member having a plurality of large-diameter portions and rotating in a direction for moving a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

sheet-thickness detection means for detecting the thickness of a sheet separated by said feeding rotating member and said inversely rotating member;

adjustment means for adjusting an amount of overlap between the large-diameter portions of said feeding rotating member and the large-diameter portions of said inveresely rotating member based on detection of the thickness of the sheet by said sheet-thickness detection means; and reading means for reading an image formed on the sheet individually separated by said feeding rotating member and said inversely rotating member.

26. An image reading apparatus comprising:

a feeding rotating member having a plurality of large-diameter portions and rotating in a direction for moving a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

adjustment means for adjusting an amount of overlap between the large-diameter portions of said feeding rotating member and the large-diameter portions of said inversely rotating member;

mode setting means for setting a separation adjusting mode in which separation adjustment between said feeding rotating member and said inversely rotating member is performed for each sheet, and a fixing mode in which separation adjustment is not performed for each sheet;

separation-position storage means for storing the amount of overlap; and reading means for reading an image formed on the sheet individually separated by said feeding rotating member and said inversely rotating member, wherein when the separation adjusting mode has been set by said mode setting means, adjustment control of the amount of overlap is performed for each sheet, and when the fixing mode has been set by said mode setting means, adjustment is performed based on the amount of overlap stored in said separation-position storage means.

27. A sheet feeding device comprising:

a feeding rotating member having a plurality of large-diameter portions and rotating in a direction for feeding a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction; and automatic adjustment means for automatically adjusting an amount of overlap between the large-diameter portions of said feeding rotating member and the large-diameter portions of said inversely rotating member in accordance with a load in a rotating direction of said feeding rotating member of a sheet entering between said feeding rotating member and said inversely rotating member.

28. A device according to claim 27, wherein said automatic adjustment means sets the amount of overlap to a maximum before a sheet-feeding operation and then reduces the amount of overlap in accordance with the load of a sheet entering between the feeding rotating member and the inversely rotating member.

29. A device according to claim 28, wherein said automatic adjustment means comprises reset means for resetting the amount of overlap to the maximum after a sheet-feeding operation.

30. A sheet feeding device comprising:

feeding rotating means for feeding sheets in a sheet-feeding direction;

separating means opposed to said feeding rotating means for separating the sheets one by one; and automatic adjustment means for automatically adjusting an amount of gap between said feeding rotating means and said separating means in accordance with a load in a sheet-feeding direction of a sheet entering between said feeding rotating means and said separating means.

31. A device according to claim 30, wherein said automatic adjustment means sets the amount of overlap to a maximum before a sheet-feeding operation and then reduces the amount of overlap in accordance with the load of a sheet entering between said feeding rotating means and said separating means.

32. A device according to claim 31, wherein said automatic adjustment means comprises reset means for resetting the amount of overlap to the maximum after a sheet-feeding operation.

33. A device according to claims 30, wherein said feeding rotating means is a feeding roller and said separating means is an inversely rotating roller.

34. An image reading apparatus comprising:

a feeding rotating member having a plurality of large-diameter portions and rotating in a direction for feeding a sheet in a sheet-feeding direction;

an inversely rotating member having a plurality of large-diameter portions alternately disposed with respect to the large-diameter portions of said feeding rotating member and rotating in a direction tending to move a sheet in a direction reverse to the sheet-feeding direction;

automatic adjustment means for automatically adjusting an amount of overlap between the large-diameter portions of said feeding rotating member and the large-diameter portions of said inversely rotating member in accordance with a load in a rotating direction of said feeding rotating member of a sheet entering between said feeding rotating member and said inversely rotating member; and reading means for reading an image formed on the sheet individually separated by said feeding rotating member and said inversely rotating member.

35. An image forming apparatus comprising:

feeding rotating means for feeding sheets in a sheet-feeding direction;

separating means opposed to said feeding rotating means for separating the sheets one by one;

automatic adjustment means for automatically adjusting an amount of gap between said feeding rotating means and said separating means in accordance with a load in a sheet-feeding direction of a sheet entering between said feeding rotating means and said separating means; and reading means for reading an image formed on a sheet separated by said feeding rotating member and said inversely rotating member.

* * * * *

UNITED STATES PATENT AND TRADEMARK OFFICE

CERTIFICATE OF CORRECTION

PATENT NO. : 5,449,162

DATED : September 12, 1995

INVENTOR(S) : YOSHIHIRO SAITO, ET AL.

It is certified that error appears in the above-indentified patent and that said Letters Patent is hereby corrected as shown below:

On the Title page

Column [57] ABSTRACT,
line 11, "inveresely-rotating" should read --inversely-rotating--.

Column 3,
line 19, "According" should read --According to--.

Column 4,
line 22, "line 8-8" should read --line 8-8'--.

Column 7,
line 22, "desribed." should read --described.--.

Column 10,
line 41, pass," should read --pass.--.

Column 11,
line 1, "208a" should read --205a--.

Column 12,
line 44, "direction" should read --direction.--.

Column 15,
line 57, "inveresely" should read --inversely--.

Column 16,
line 35, "inveresely" should read --inversely--; and
line 38, "claim 17," should read --claim 16,--.

UNITED STATES PATENT AND TRADEMARK OFFICE

CERTIFICATE OF CORRECTION

PATENT NO. : 5,449,162

DATED : September 12, 1995

INVENTOR(S) : YOSHIHIRO SAITO, ET AL.

It is certified that error appears in the above-indentified patent and that said Letters Patent is hereby corrected as shown below:

Column 17,
line 44, "directing" should read --direction--.

Column 18,
line 22, "inveresely" should read --inversely--; and
line 44, "inveresely" should read --inversely--.

Column 20,
line 13, "claims 30," should read --claim 30,--.

Signed and Sealed this

Twentieth Day of February, 1996

Bruce Lehman

*Attest:*

BRUCE LEHMAN

*Attesting Officer*

*Commissioner of Patents and Trademarks*